United States Patent [19]

Steinbach

[11] Patent Number: 4,983,060

[45] Date of Patent: Jan. 8, 1991

[54] APPLIANCE FOR THE TREATMENT OF TEXTILE FLOOR COVERINGS

[75] Inventor: Gerhard Steinbach, Duesseldorf, Fed. Rep. of Germany

[73] Assignee: Henkel Kommanditgesellschaft auf Aktien, Duesseldorf, Fed. Rep. of Germany

[21] Appl. No.: 394,616

[22] Filed: Aug. 16, 1989

[30] Foreign Application Priority Data

Aug. 16, 1988 [DE] Fed. Rep. of Germany ..... 3827781
Feb. 24, 1989 [DE] Fed. Rep. of Germany ..... 3905760

[51] Int. Cl.[5] ..... A47L 13/26; A46B 11/06; A46B 9/02

[52] U.S. Cl. ..... 401/140; 401/284

[58] Field of Search ..... 401/140, 282, 285, 288, 401/284

[56] References Cited

U.S. PATENT DOCUMENTS

| | | | |
|---|---|---|---|
| 938,735 | 11/1909 | Wolfgram | 401/288 X |
| 1,049,797 | 1/1913 | Arntt | 401/140 |
| 1,091,888 | 3/1914 | Lorzing | 401/288 |
| 1,333,741 | 3/1920 | Thomas | 401/285 |
| 1,393,133 | 10/1921 | Jarusz | 401/189 |
| 1,731,339 | 10/1929 | Hemple | 401/288 |
| 2,243,607 | 5/1941 | Rosen | 401/285 X |
| 2,633,590 | 4/1953 | Mitchell | 15/131 |
| 2,641,011 | 6/1953 | Caronia | 401/140 X |
| 3,081,481 | 3/1963 | Nohl et al. | 14/543 |
| 3,806,261 | 4/1974 | Soultanian | 401/42 |
| 4,057,353 | 11/1977 | Kitatani | 401/43 |

FOREIGN PATENT DOCUMENTS

| | | |
|---|---|---|
| 1142431 | 3/1959 | Fed. Rep. of Germany . |
| 2624464 | 6/1976 | Fed. Rep. of Germany . |
| 939837 | 6/1962 | United Kingdom . |

*Primary Examiner*—Richard J. Johnson
*Attorney, Agent, or Firm*—Ernest G. Szoke; Wayne C. Jaeschke; Real J. Grandmaison

[57] ABSTRACT

A manually operated appliance for the treatment of textile floor coverings with a foaming cleaning liquid, comprising a shaft-like handle with a bristled cleaning element attached thereto, a container for cleaning liquid replaceably mounted on the handle by means of a holding element, and a hose for connecting the container and cleaning element which is operatively connected to a dosing mechanism regulating the outflow of cleaning liquid from the container. The hose has a grooved internal profile and the cleaning element is a hollow brush having an inlet nozzle on its top surface for the hose level with a socket for fixing the handle. Outlet holes face the floor between rows of bristles arranged at the outer edges of the hollow brush, and a distributor plate covers the brush surface.

6 Claims, 5 Drawing Sheets

APPLIANCE FOR THE TREATMENT OF TEXTILE FLOOR COVERINGS

BACKGROUND OF THE INVENTION

1. Field of the Invention

This invention relates to an appliance for the treatment of textile floor coverings with a foaming cleaning liquid comprising a shaft-like handle with a bristled cleaning element attached thereto, a container for cleaning liquid replaceably mounted on the handle by means of a holding element and a hose for connecting the container and cleaning element which is operatively connected to a dosing mechanism regulating the outflow of cleaning liquid from the container.

2. Discussion of Related Art

For cleaning carpets and floor coverings, cleaning solutions or powders, particularly shampoos, are normally worked into the pile by machines having one or more rotary brushes, brush roller machines and the like. For relatively small areas where machines cannot effectively be used, the cleaning solution or liquid is manually applied. In practice, this is done by placing the cleaning solution in a bucket and applying it to the carpet or floor covering by means of a brush. However, it is not possible in this way to uniformly wet the pile so that, in the case of foaming cleaning liquids, foaming is not always particularly uniform, because the foam is produced solely by the rubbing movement of the brush on the pile, resulting in uneven cleaning of the pile.

German Pat. No. 28 34 644 describes an appliance of the afore-mentioned type which, on the one hand, comprises a dosing mechanism arranged in the handle in an extremely complicated manner and which, on the other hand, comprises a conventional scrubbing brush as the cleaning element.

According to U.S. Pat. No. 2,633,590, a container for the cleaning liquid is provided with a brush comprising outflow holes which is arranged near the floor with the handle integrated therein.

The problem addressed by the present invention is to provide an improved appliance of the type herein in such a way that it is simple and uncomplicated in construction, commercially available brushes and handles can be readily fitted thereto, foaming of the cleaning liquid is improved and the cleaning liquid is applied more uniformly to the carpet.

DESCRIPTION OF THE INVENTION

Other than in the operating examples, or where otherwise indicated, all numbers expressing quantities of ingredients or reaction conditions used herein are to be understood as modified in all instances by the term "about".

In an appliance of the type mentioned herein, this problem is solved in accordance with the invention by the fact that the hose has a grooved internal profile and the cleaning element is a hollow brush having an inlet nozzle on its top surface for the hose at a level even with a socket for fixing the handle to the cleaning element, and outlet holes facing the floor between rows of bristles arranged at the outer edges of the hollow brush. A distributor plate covering the brush surface is provided under the outlet holes and ends at the rows of bristles which are arranged at intervals from and beneath the outlet holes.

The effect of the grooved profile of the hose between the container and the brush is that the rate of flow of the cleaning liquid is reduced there and, when the brush-like appliance is moved forward and backward during the cleaning of textile floor coverings, foam is initially produced in the hose itself. This foam then passes into the hollow brush and issues through the outlet holes therein onto the distributor plate. The foam evens out on the distributor plate and is fed to the bristle tufts from which it is transferred to the floor to be cleaned. The hollow brush is moved uniformly over the floor covering to be cleaned and is supplied uniformly and continuously with a predetermined quantity of cleaning liquid or foam. The prefoamed cleaning liquid passes through the bristles onto the floor covering where the foam for cleaning the textile floor covering is then fully generated by means of the bristles during the forward and backward movement of the appliance.

In another embodiment of the invention, a suitably long path for producing the prefoaming effect is available particularly when a holding element is arranged at grip height on a shaft-like handle and the dosing mechanism in the form of a dosing valve is arranged in the hose at substantially the same level. By means of the container for cleaning liquid, particularly the dosing valve, arranged near the grip of the handle, the quantity of cleaning liquid dispensed per unit of time can be adapted to the cleaning rate and to the uptake capacity of the carpet or textile floor covering to be treated so that the carpet fibers are wetted substantially uniformly over the entire area of carpet.

In another embodiment of the invention, it is of advantage for the uniform distribution of the prefoamed cleaning liquid on the distributor plate if the distributor plate is fixed centrally to the underside surface of the brush by means of a spacer element because the foam can then be spread smoothly over the distributor plate.

In another advantageous embodiment of the invention, the bristles along each longitudinal side edge of the brush consist of at least two rows of bristle tufts which are preferably offset from one another. Uniform distribution of the cleaning liquid is further promoted in this way.

The bristle tufts preferably consist of drilled bristles, preferably of polypropylene.

Finally, in another embodiment of the invention, the holding element comprises a funnel-like holder for upsidedown introduction of the container, in the bottom of which is arranged a piercing pin projecting into the holding space of the holder with an outflow hole, a dosing valve and a hose attachment nozzle for connecting the interior of the container and the hose. This construction of the holding element is particularly appropriate in cases where non-reuseable containers filled with prepared cleaning solution are to be used.

BRIEF DESCRIPTION OF THE DRAWINGS

Embodiments of the invention are described by way of example in the following with reference to the accompanying drawings, wherein.

DETAILED DESCRIPTION OF THE DRAWINGS

Figure 1:
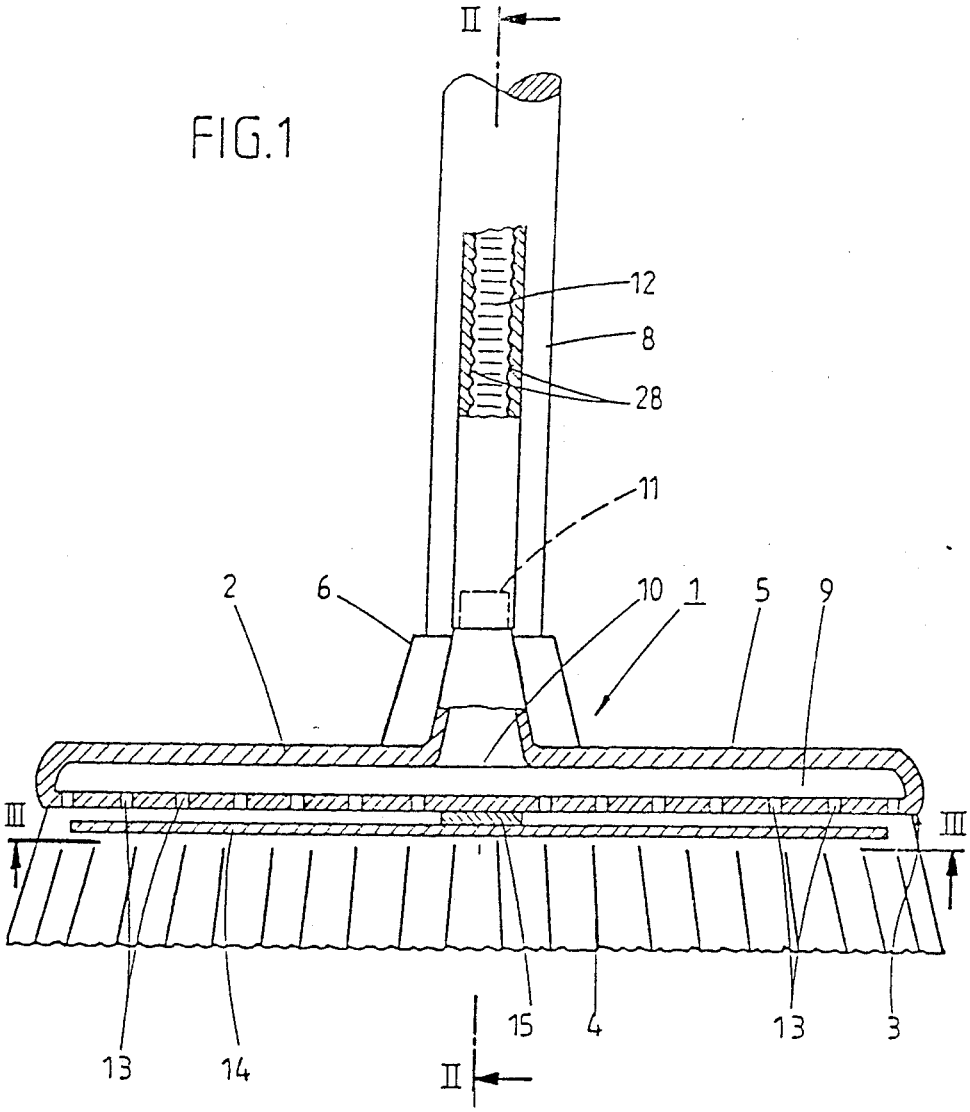
FIG. 1 is a longitudinal section through a hollow brush with handle.

The brush 1 generally denoted by the reference 1 comprises a hollow brush 2 with bristles 4 on its underneath surface 3 and a brush socket 6 integrally formed on its upper surface 5 with a screwthread 7 for receiving a brush handle 8 provided at its end with a corresponding screwthread. The brush socket 6 is arranged in the middle of one longitudinal side of the hollow brush 2 offset from the longitudinal axis towards the edge 18. The hollow brush 2 has a hollow interior or manifold 9 with a passage 10 which projects from the upper surface 5 of the hollow brush 2 at the level of the brush socket 6 and comprises an inlet nozzle 11 for receiving a hose 12. The underneath surface 3 of the hollow brush 2 comprises a plurality of holes 13 which are covered on the floor side by a distributor plate 14 arranged at a space therefrom. The distributor plate 14 is fixed centrally to the underneath surface 3 of the hollow brush 2 by means of a spacer 15. The distributor plate 14 covers the entire floor-facing area of the hollow brush 2 which is not provided with bristles. The bristles 4 consist of individual bristle tufts 16 which are arranged along the longitudinal side edges 17 and 18 of the hollow brush 2 in two rows, the individual tufts 16 being offset from one another. At the broad side edges 19 and 20, the tufts 16 are arranged in a single row.

Figure 4:
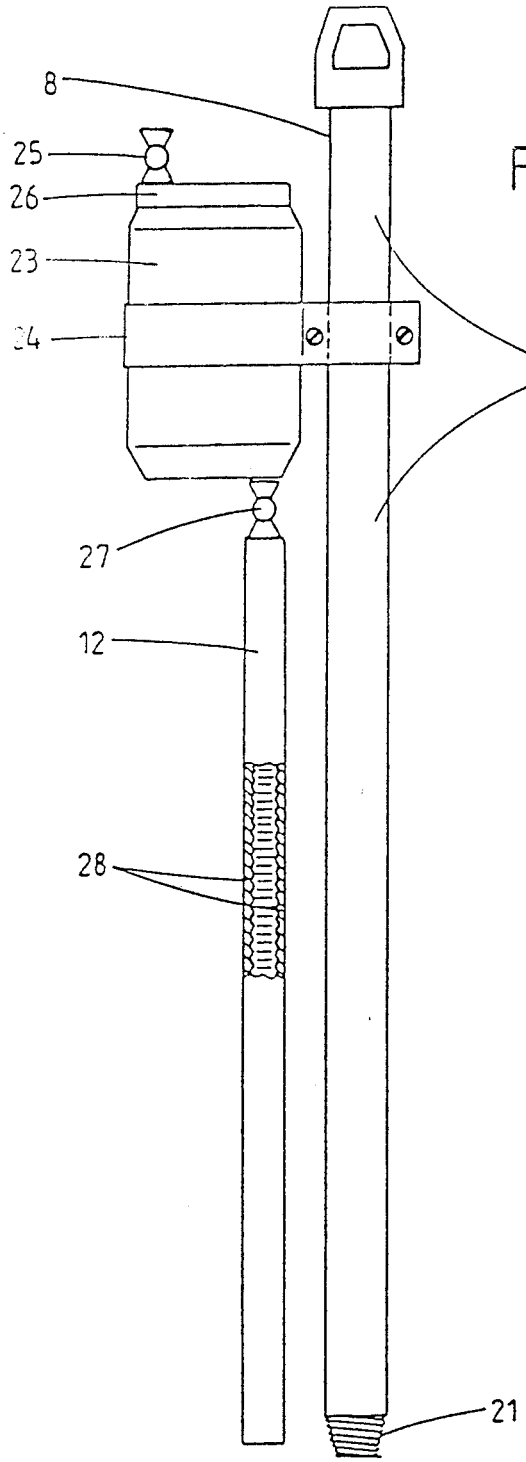
FIG. 4 is a view, partly in section, of a brush handle with the container and hose attached thereto.

FIG. 4 shows one embodiment of the handle 8. At its lower end, the handle 8 comprises a screwthread 21 for fixing in the brush socket 6. A container 23 for cleaning liquid is attached to the handle 8 by clips 24 near the grip 22 of the brush handle 8. The container 23 is preferably made of plastic and has a capacity of 1–2 liters. The container 23 has a large filling opening designed to be closed by a cover 26 with a vent valve 25. At its end facing the floor, the container 23 has an outlet for receiving a dosing valve 27 incorporated in the hose 12. The dosing hose 12 has a grooved internal profile 28 and joins the outlet of the container 23 to the inlet nozzle 11 of the hollow brush 2 (see FIG. 1).

The hollow brush 2 is preferably made of plastic and has dimensions of approximately 280×42×55 mm. The holes 13 in the underneath surface 3 of the brush may be uniformly distributed and may all have the same diameter of approximately 2 mm. However, the holes at the broad side edges 19 and 20 furthest from the inlet nozzle 11 may also be larger in size and/or in number than those in the middle of the brush. The spacer 15 has a thickness of approximately 3 mm.

The individual bristle tufts 16 preferably consist of drilled polypropylene bristles.

In the in-use position with the dosing valve 27 open, the foamable cleaning liquid flows out from the container 23 through the hose 12 and the inlet nozzle 11 into the hollow interior 9 of the hollow brush 2. The internal grooving 28 reduces the rate of flow of the cleaning liquid, for example a shampoo solution, in the region of the hose and the backward and forward movement of the handle 8 results in prefoaming of the shampoo solution in view of its slow rate of flow in the region of the hose. The foam produced then passes into the hollow interior 9 and issues through the holes 13. It is evened out on the upper surface of the distributor plate 14 and fed continuously to the rows of bristles. The foam then runs down the individual bristle tufts onto the textile floor covering to be cleaned where it is worked into the pile with intensive foaming by means of the bristles.

The container 23 can be replaced by releasing the clips 24. However, the clips 24 may also be an integral part of the container 23.

Figure 2:
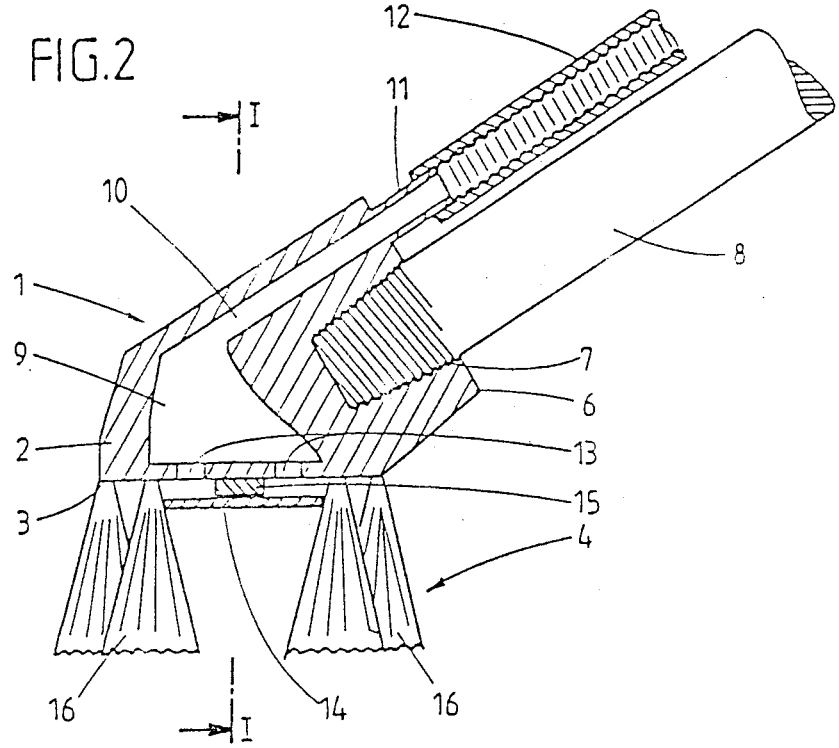
FIG. 2 is a section on the line II—II of FIG. 1.
Figure 3:
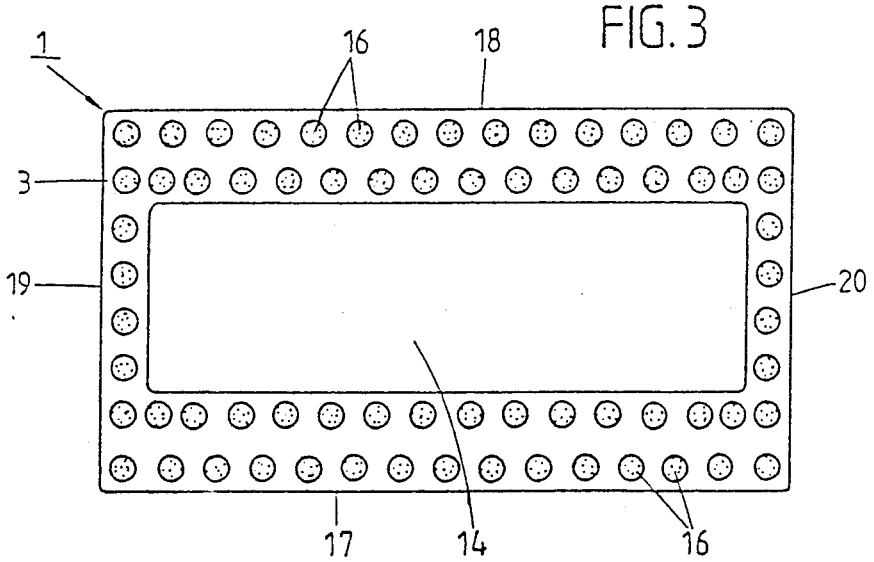
FIG. 3 is a plan view of a section on the line III—III of FIG. 1.
Figure 5:
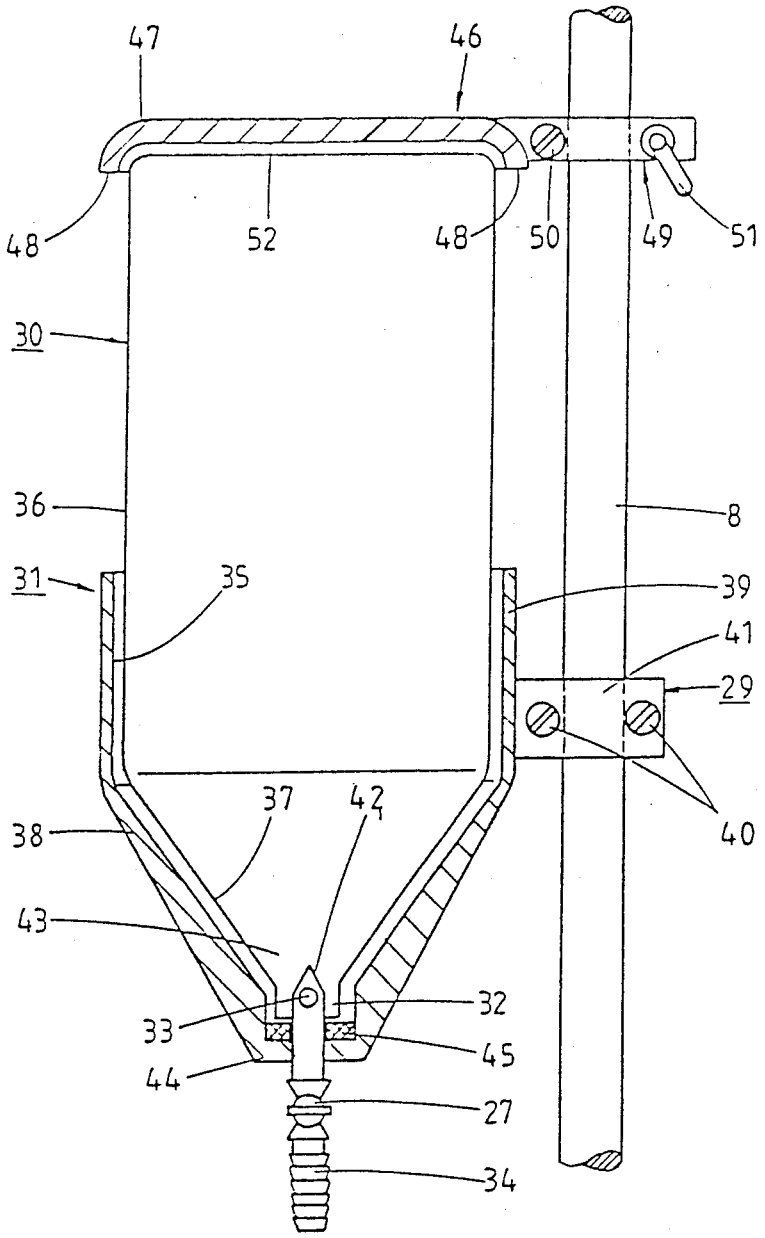
FIG. 5 shows an alternative embodiment of a holding element.
Figure 6:
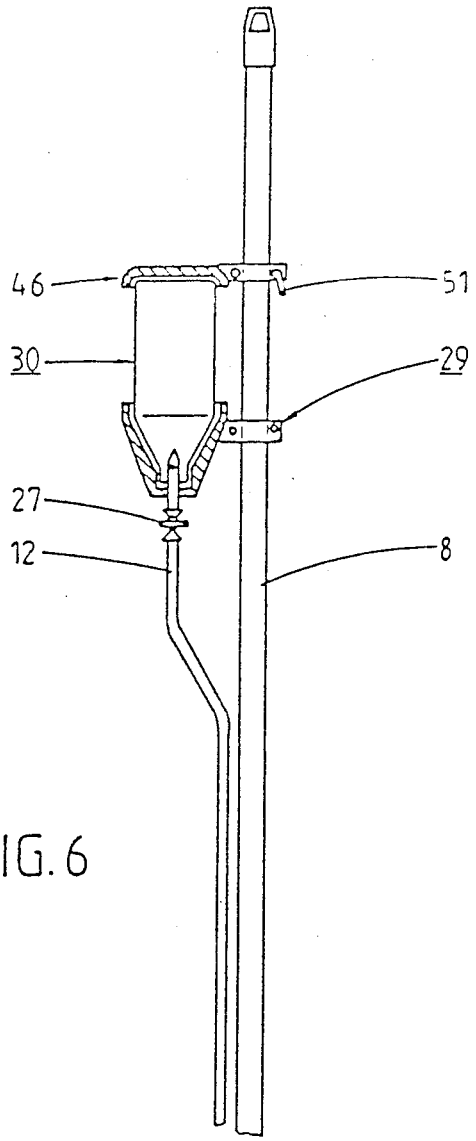
FIG. 6 is a view of a brush handle with the holding element shown in FIG. 5 attached thereto.

To enable the container for the cleaning liquid, particularly where it is a non-reuseable container, to be readily replaced and fitted to the appliance without difficulty, another embodiment of the holding element 24 is shown in FIGS. 5 and 6. FIGS. 5 and 6 show the brush handle 8 and a container of cleaning liquid, generally denoted by the reference 30, which is designed to be attached externally to the handle 8 by means of a holding element 29 and to be connected to the hollow brush 2 by the hose 12 with dosing valve 27. The brush 2 is the same as shown in FIGS. 1 and 2. The holding element 29 comprises a holder generally denoted by the reference 31 which is designed to be attached to the brush handle 8 for the upside-down introduction of the container 30 of cleaning liquid. The holder 31 comprises an outflow hole 33 which is designed to be coupled with the container opening 32 by introduction of the container and which exits to the dosing valve 27 and via a hose attachment nozzle 34 to the brush 2.

In the embodiment illustrated, the holder 31 is pot-shaped or funnel-shaped so that its internal shape 35 substantially corresponds to the external shape 36 of the container 30. At its lower end, therefore, the holder 31 may have an inner surface in the shape of a funnel 38 corresponding to the shoulders 37 of the container 30. The funnel 38 is adjoined at its upper end by a cylindrical holding region 39 which is fixed to the brush handle 8, for example by means of screws 40 and a clip 41.

In the illustrated embodiment, the holder 31 is in the form of a funnel, i.e. is as it were hollow. Basically, however, the holder may also consist simply of a U-shaped and/or V-shaped stirrup, as can be seen from the sectional view in FIG. 5. However, the hollow form, for example as a funnel, is preferred by virtue of the better sealing effect.

At the bottom of the holder 31, there is a piercing pin 42 with an outflow hole 33 which produces an outflow opening 32 in the container 30 when it is introduced into the holder. Accordingly, the outflow hole 33 represents as it were a funnel exit which projects back into the holding space 43 of the funnel 38 of holder 31. To prevent cleaning liquid from flowing down the sides of the piercing pin 42 past the edge of the container opening 32, so that it would miss the outflow hole 33, a sealing ring 45 is preferably provided at the base 44 of the funnel and becomes effective immediately after, or through, piercing of the container opening 32.

In the illustrated embodiment, the holding element comprises in addition to the holder 31 a lock 46 adjustable on the brush handle 8 for locking the container 30 of cleaning liquid in position in the holder 31. In the illustrated embodiment, the lock 46 consists of a cover or clamp 47 bent downwards at its edge 48 or at its ends to lock the container 30 in position. The cover 47 is fixed to the brush handle 8 by an additional bracket or clip 49. The clip 49 is releasably fixed to the brush handle 8 by means of screws 50 and a locking lever 51. Overall, therefore, the lock 46 forms a retaining mechanism which acts on the base 52 of the container.

I claim:

1. An appliance for treating textile floor coverings with a foaming cleaning liquid, comprising a shaft-like handle with a bristled cleaning element attached thereto, a container for cleaning liquid replaceably mounted on said handle by means of a holding element, and a hose for connecting said container and said cleaning element which is operatively connected to a dosing mechanism regulating the outflow of cleaning liquid from said container, said hose having a grooved internal profile, said cleaning element comprising a hollow or manifold brush having a handle socket and an inlet nozzle on its top surface for said hose at a level even with said socket for fixing said handle to said cleaning element, said cleaning element having outlet holes in the underside surface of said manifold, rows of bristles arranged at the outer edges of the underside surface of said manifold, and an imperforate distributor plate spaced from and covering the underside surface of said manifold brush which is not provided with bristles.

2. An appliance as in claim 1 wherein said holding element is positioned at grip height on said shaftlike handle and said dosing mechanism is positioned in said hose at substantially the same level.

3. An appliance as in claim 1 wherein said dosing mechanism comprises a valve.

4. An appliance as in claim 1 wherein said distributor plate is fixed centrally to the underside surface of said manifold by means of a spacer.

5. An appliance as in claim 1 wherein the bristles along each longitudinal side edge of said manifold comprise at least two rows of bristle tufts which are offset from one another.

6. An appliance as in claim 5 wherein said bristle tufts comprise drilled bristles of polypropylene.

* * * * *